United States Patent [19]

Trubitsyn et al.

[11] Patent Number: 4,502,895

[45] Date of Patent: Mar. 5, 1985

[54] PROCESS FOR MAKING BRASS-PLATED LONG-SIZE ARTICLES

[75] Inventors: Alexandr V. Trubitsyn; Georgy M. Fomin; Ivan N. Nedovizy; Pavel E. Petrov; Petr I. Denisov; Sergei A. Tulupov; Stepan T. Chursin; Vladimir N. Kuptsynov; Adolf K. Merkulov; Lev G. Stobbe, all of Magnitogorsk, U.S.S.R.

[73] Assignee: Vsesojuzny Nauchno-Issledovatelsky Institut Metiznoi Promyshlennosti, Magnitogorsk, U.S.S.R.

[21] Appl. No.: 364,846

[22] PCT Filed: Jul. 31, 1980

[86] PCT No.: PCT/SU80/00125

§ 371 Date: Mar. 23, 1982

§ 102(e) Date: Mar. 23, 1982

[87] PCT Pub. No.: WO82/00479

PCT Pub. Date: Feb. 18, 1982

[51] Int. Cl.[3] ..... C25D 7/06; C25D 5/36; C25D 3/66

[52] U.S. Cl. ..... 148/11.5 Q; 204/28; 204/32.1; 204/35.1; 204/37.1; 204/38.4; 204/39

[58] Field of Search ..... 204/32 R, 35 R, 37 R, 204/39, 40, 43 Z, 28, 38 B; 148/11.5 Q, 127

[56] References Cited

U.S. PATENT DOCUMENTS

| | | | |
|---|---|---|---|
| 1,934,741 | 11/1933 | Schulein | 148/7 |
| 2,075,331 | 3/1937 | Antisell | 204/11 |
| 2,392,456 | 1/1946 | Brown et al. | 204/37 |
| 2,422,902 | 6/1947 | Huston | 204/32 |
| 2,762,763 | 9/1956 | Kenmore et al. | 204/28 |
| 2,971,899 | 2/1961 | Hanink et al. | 204/29 |
| 3,046,205 | 7/1962 | Couch et al. | 204/37 |

FOREIGN PATENT DOCUMENTS

| | | |
|---|---|---|
| 1070241 | 6/1967 | United Kingdom . |
| 150727 | 11/1961 | U.S.S.R. . |
| 213511 | 4/1976 | U.S.S.R. . |

OTHER PUBLICATIONS

Metal Finishing Guidebook and Directory for 1978, Metals and Plastics Publications, Inc., Hackensack, N.J. pp. 151–155.

Pp. 72, 187 and 188 of "Advice to Plant Process Engineer", L. Ya. Popilov, Handbook, Lenizdat Publishing House, 1975 (with translation).

Pp. 191, 197 of "Technology of Electrochemical Coatings" Ya. V. Vainer, M. A. Dasoyan, Leningrad, "Machinostrojenie" Publishing House, 1972 (with translation).

P. 146, "Equipment of Electroplating Shops", Ya. V. Vainer, M. A. Dasoyan, Machinostroenie Publishing House, Leningrad, 1971 (with translation).

Pp. 78–79, "Mechanization and Automation in Heat--Treatment Shops", The State Science & Technology Publishing House, Mechanical Engineering Department, Moscow, 1962, Sverdlovsk (with translation).

*Primary Examiner*—G. L. Kaplan
*Assistant Examiner*—William T. Leader
*Attorney, Agent, or Firm*—Fleit, Jacobson, Cohn & Price

[57] ABSTRACT

An apparatus for making a brass-plated long-size article by a process for making a brass-plated long-size article comprises a bath 3 with molten inorganic salts, wherein the surface of a blank 1 is degreased and etched. Then the surface of the blank 1, after deposition of a layer of copper, is coated with a layer of zinc in a unit 8 for electrolytical coating of the surface of the blank 1 with a layer of zinc and thermodiffusive treatment and tempering of the blank 1 are effected in a bath 11 with molten salts.

11 Claims, 6 Drawing Figures

PROCESS FOR MAKING BRASS-PLATED LONG-SIZE ARTICLES

FIELD OF THE INVENTION

The present invention relates to processes and apparatus for thermal elecroplating of metals, and more specifically, to processes and apparatus for making a brass-plated long-size articles.

BACKGROUND OF THE INVENTION

In modern processes for brass-plating of long-size articles use is made either of electrolytical brass-plating processes contemplating the use of complex-salt, mainly cyanides, aqueous electrolytes for plating of articles preliminarily heat-treated, or processes of separate electrolytical copper-plating and zinc-plating from aqueous solutions, followed by thermodiffusion treatment and tempering.

However, these brass-plating processes are rather multioperational ones and appropriate apparatus are low-productive and do not enable intensification of the process mainly due to an insufficient heat exchange in muffle furnaces. Carrying out the process of heat-treatment within a wide temperature range is hindered due to temperature drop across the furnace muffles thus producing a detrimental effect to the uniformity of the properties of the resulting articles. Furthermore, stacks of furnaces often have local burning-through, the gas composition is changed or the gas is absent altogether, thus producing a negative effect on one of the main properties of brass-plated articles—tenacity of adherence to rubber.

Known in the art is a process for making brass-plated long-size articles (cf. USSR Inventor's Certificate No. 150727 Int. Cl. C 23 D 5/52 published in "Bulletin of Discoveries, Inventions, Industrial Designs and Trademarks", No. 19, 1962, p. 52) by way of degreasing and etching of the blank surface, coating its surface with a layer of copper, electrolytical zinc-plating of the blank surface, thermodiffusive treatment and tempering of the blank, followed by finishing of the articles. In this process degreasing and etching of a blank are effected successively in solutions of alkalis and acids with application of electric current.

Deposition of copper and zinc layers onto the surface of a blank is effected electrolytically from aqueous solutions, while thermodiffusive treatment and tempering of the blank are effected by heating with a convective heat exchange in the air medium.

However, the prior art process due to the use of solutions of alkalis and acids necessitates an increased rate of water consumption for washing of articles and neutralization of the spent liquors. In doing so, the spent solutions especially those containing complex compounds of copper hardly susceptible to regeneration bring about pollution of water basins.

Owing to oxidation of the surface of a brass-plated long-size article during the heat-treatment according to the prior art process, for a better adherence e.g. to rubber, additional etching of its surface in acid solutions is required, which results in an inefficient consumption of non-ferrous metal.

Furthermore, in the manufacture of a brass-plated long-size article by the process referred to hereinabove, a plastic deformation is inevitably observed due to bending of the article, which necessitates subsequent straightening of the latter, thus resulting in impaired quality characteristics thereof and, in the first place, in respect of adherence to rubber.

Known in the art is an apparatus for making brass-plated long-size articles by the above-disclosed process and comprising disposed along the direction of movement of a blank: a unit for degreasing and etching of the blank surface, a bath with a solution for copper-plating of the blank surface, a unit for electrolytical plating of the blank with a zinc layer, incorporating a bath with a solution for electrolysis, wherein there are provided an anode, a unit for heating the blank, a unit of a thermodiffusive treatment and tempering of the blank, as well as a unit for straightening of the blank.

In this apparatus as the unit for degreasing and etching, as well as a unit for electrolytical coating of the blank surface with a layer of zinc, use is made of electrolytical baths with appropriate solutions for electrolysis; as a unit for thermodiffusive treatment and tempering use is made of a tubular furnace with a convective heat transfer; as the unit for straightening of the blank use is made of a roller straightening means.

However, in this apparatus the baths with a solution for etching, degreasing, copper- and zinc-plating have a considerable length and equipped with sophisticated and expensive electroplating equipment. The process and apparatus described hereinabove also feature considerable inefficient consumption of copper and zinc.

The tubular furnace employed in the above-described apparatus for thermodiffusive treatment and tempering of a blank does not make it possible to intensify the process, since elevation of temperature above 520° C. results in a considerable evaporation of zinc, while extension of its length causes substantial heat losses and rapid deterioration of furnace stacks.

In addition, the above-disclosed apparatus is difficult in servicing and maintenance due to a considerable length of its assemblies and units and difficulties associated with introducing of a long-size article thereinto.

DISCLOSURE OF THE INVENTION

The present invention is directed to the provision of a process for the manufacture of a brass-plated long-size articles, wherein degreasing and etching, as well as thermodiffusive treatment and tempering of a blank would be effected so as to improve the uniformity of properties of an article, ameliorate a phase composition of the brass coating, ensure identity of conditions for the treatment of a brass-plated long-size article through maximum possible combination of operations, as well as to provide an apparatus for implementation of this process having such an arrangement and such additional units which would make it possible to improve the uniformity of properties of the final article and phase composition of the brass coating, as well as to ensure identical conditions for the treatment of a brass-plated long-size article.

This object is accomplished by that in a process for the manufacture of a brass-plated long-size article by way of degreasing and etching of the surface of a blank, coating of the blank surface with a layer of copper, electrolytical coating of the blank surface with a layer of zinc, thermodiffusive treatment and tempering of the blank and straightening of the article, in accordance with the present invention, degreasing and etching of the blank surface, as well as thermodiffusive treatment and tempering of the blank are effected in molten inorganic salts separately.

It is advisable that straightening of the article be combined with thermodiffusive treatment and tempering of the blank at the temperature of molten inorganic salts which is less than 50° C. higher than the recrystallization temperature of the material of the long-size article.

It is also advisable that the electrolytical plating of the blank surface with a layer of zinc be combined with tempering of the blank upon deposition of zinc by electrolysis of molten inorganic salts onto the blank heated to the temperature of melting of the inorganic salts.

It is also advisable that heating of the blank to the melting temperature of the salts be effected in molten inorganic salts.

It is desirable that the coating of the blank surface with a layer of copper prior to deposition of a layer of zinc by electrolysis of molten inorganic salts be effected by dipping thereof into an acidic solution of copper sulphate.

It is also advisable that prior to coating of the blank surface with a layer of zinc by electrolysis of molten inorganic salts the copper layer be densified.

This is also accomplished by that in an apparatus for the manufacture of a brass-plated long-size article the apparatus comprises, mounted in the direction of the blank movement: a unit for degreasing and etching of the blank surface, a bath with a solution for coating of the blank surface with a layer of copper, a unit for electrolytically coating the blank surface with a layer of zinc comprising a bath with a solution for electrolysis incorporating an anode, a unit for a thermodiffusive treatment and tempering of the blank and a unit for straightening of the blank, in accordance with the present invention the unit for degreasing and etching of the blank and the unit for thermodiffusive treatment and tempering of the blank are made respectively as baths with molten organic salts, each of the baths having an inlet and outlet slots.

It is desirable that the bath with molten salts would have a cooling means for preventing outflow and entrainment, with the brass-plated long-size article, of molten inorganic salts which means should be mounted at the outlet slot.

It is advisable that the cooling means would comprise a plate with recesses provided therein for passing the blank and mounted under this plate a chamber for cooling molten salts on the blank surface.

It is also advisable that the bath with molten salts, wherein thermodiffusive treatment and tempering of the blank are effected would simultaneously serve as a unit for straightening of the article.

It is further desirable that in the unit for electrolytical coating of the blank surface with a layer of zinc as the bath with a solution for electrolysis use would be made of a bath with molten inorganic salts, wherein there are effected thermodiffusive treatment and tempering of the blank, the anode be made as a chamber filled with zinc and placed inside the bath, while the apparatus itself also incorporate a unit for heating the blank to the temperature of melting of the inorganic salts which would be mounted along the movement of the blank prior to the zinc-filled chamber.

It is preferable that the bath with molten inorganic salts, wherein thermodiffusive treatment and tempering of the blank are effected would serve as the unit for heating the blank to the melting temperature of the inorganic salts. In doing so, it is possible that before that bath with molten inorganic salts wherein thermodiffusive treatment and tempering of the blank are effected, a unit for densification of the copper layer on the blank surface be mounted in the direction of the blank movement.

The present invention ensures intensification of the process for the manufacture of a brass-plated long-size article due to the use of liquid heating agents for carrying-out diffusion processes to increase heat-transfer coefficients by one or two orders of magnitude and to eventually increase the apparatus productivity. The present invention also makes it possible to simplify the process for the manufacture of a brass-plated long-size article simultaneously with an improved surface finish quality by providing an oxidation-free heating and uniformity of the phase composition of brass.

Furthermore, the present invention creates identical conditions for the treatment of long-size articles through combination of several operations in one unit, thus providing for the manufacture of more uniform characteristics of quality of the articles.

The present invention also creates the possibility for making a straight brass-plated long-size article without any additional operation of straightening in special devices.

The present invention also makes it possible to reduce consumption of water, exclude the use of expensive hardly available reagents from the process and to replace them with less expensive and more widely available.

BRIEF DESCRIPTION OF THE DRAWINGS

The present invention is further explained by the description of specific examples of its embodiment, reference being made to the accompanying drawings, wherein.

BEST EMBODIMENTS OF THE INVENTION

The process according to the present invention comprises manufacture of a brass-plated long-size article by degreasing and etching the blank surface in molten inorganic salts, coating the blank surface with a layer of zinc, carrying out thermodiffusive treatment and tempering of the blank in molten inorganic salts, followed by straightening of the article.

The article straightening is combined with thermodiffusive treatment and tempering of a blank at a temperature of molten salts exceeding by at most 50° C. the temperature of recrystallization of the material of a long-size article.

Electrolytical coating of the blank surface with a layer of zinc is combined with tempering of the blank by depositing zinc through electrolysis of molten inorganic salts onto the blank preliminarily heated to the melting temperature of the salts.

Heating of the blank to the melting temperature of inorganic salts is effected in molten inorganic salts.

Coating of the blank surface with a layer of copper prior to deposition of a layer of zinc by electrolysis of molten inorganic salts is effected by immersing it into an acidic solution of copper sulphate.

Prior to coating the blank surface with a layer of zinc by electrolysis of molten inorganic salts the copper layer is densified.

The apparatus according to the present invention for making a brass-plated long-size article by the process of the present invention has the following arrangement.

Figure 1:
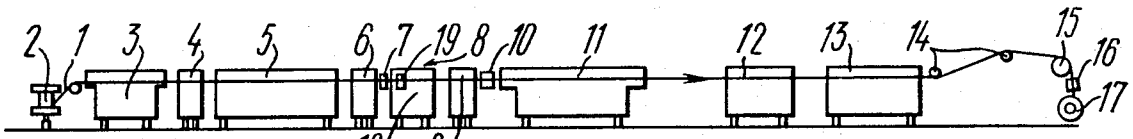
FIG. 1 shows a structural scheme of the device for carrying out the process according to the present invention for the manufacture of a brass-plated long-size article.

The apparatus for making a brass-plated long-size article according to the present invention as illustrated in FIG. 1 comprises mounted in the direction of movement of blank 1 (hereinafter referred to as wire 1), a unit of uncoiling 2, a bath 3 with molten inorganic salts for degreasing and etching of the surface of wire 1, a bath 4 for washing, a bath 5 with a solution for coating the surface of wire 1 with a layer of copper, a bath 6 for washing, a unit 7 for densification of the layer of copper, a unit 8 for electrolytically coating the wire with a layer of zinc, a bath 9 for washing, a unit 10 for heating the wire to the melting temperature of inorganic salts, a bath 11 with molten inorganic salts for thermodiffusion treatment and tempering of wire 1, a washing bath 12, a unit 13 for drying wire 1, guiding rolls 14, a unit 15 for drawing, a straightening unit 16 and unit 17 for wire coiling. The unit 8 has a bath 18 with a solution for electrolysis, wherein an anode 19 is provided.

Figure 2:
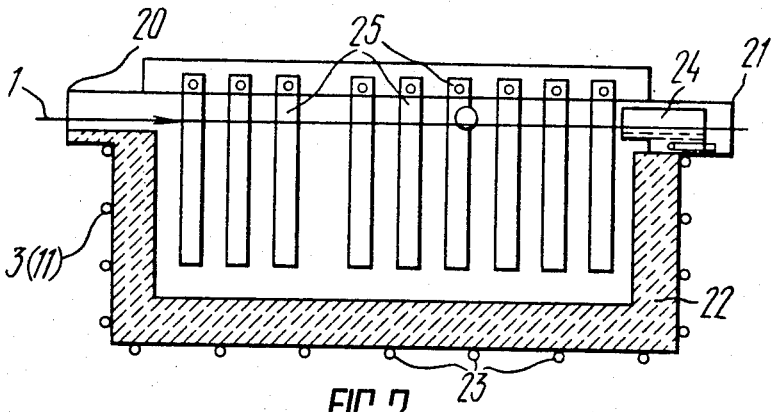
FIG. 2 shows a bath for molten salts with a blank according to the present invention (the bath is shown in transversal elevation)

The structure of the bath 3 is similar to that of bath 11 and shown in FIG. 2. The bath 3 (11) has an inlet slot 20 for wire 1 and an outlet slot 21. The inside surface of the bath 3 (11) is lined with a heat-insulation material 22 and tubular cooling coils 23 are welded to its outside surface for the purpose of cooling.

Inside the bath 3 (11) at the outlet slot 21 there is disposed a cooling means 24 to prevent molten salts from outflow and entrainment with the brass-plated article. Electrodes 25 are provided in the bath 3 for heating of the inorganic salts.

Figure 3:
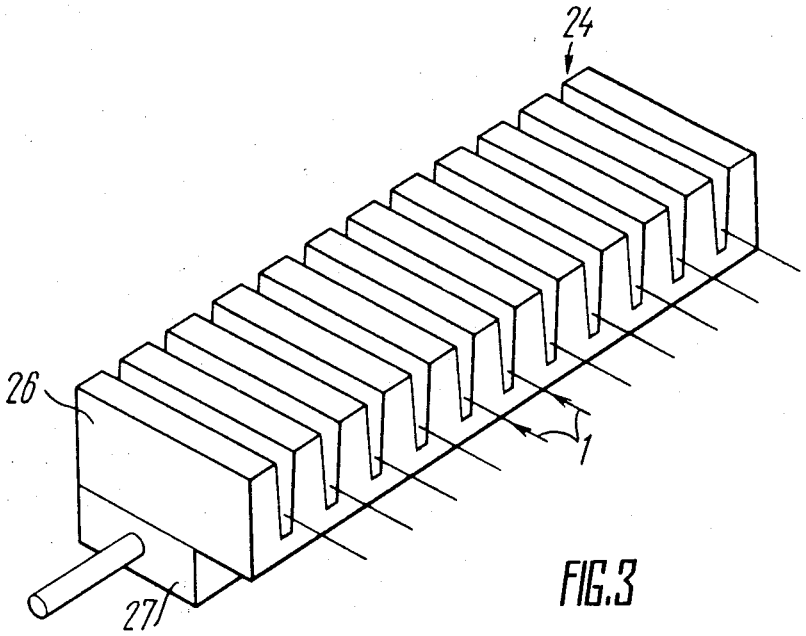
FIG. 3 is a cooling means according to the present invention, isometric view.

The cooling means 24 (FIG. 3) has a plate 26 with provided therein conically shaped recesses for passing wire 1 and a cooled chamber 27 mounted under this plate 26.

Figure 4:
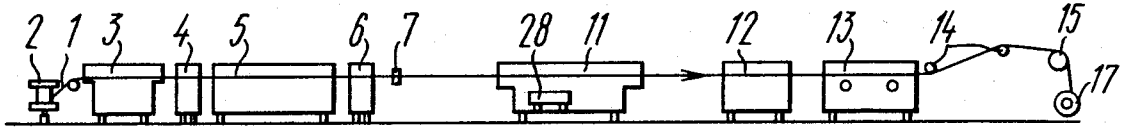
FIG. 4 is a structural scheme of the apparatus for the manufacture of a brass-plated long-size article, wherein the anode is made as a chamber filled with zinc according to the present invention.
Figure 5:
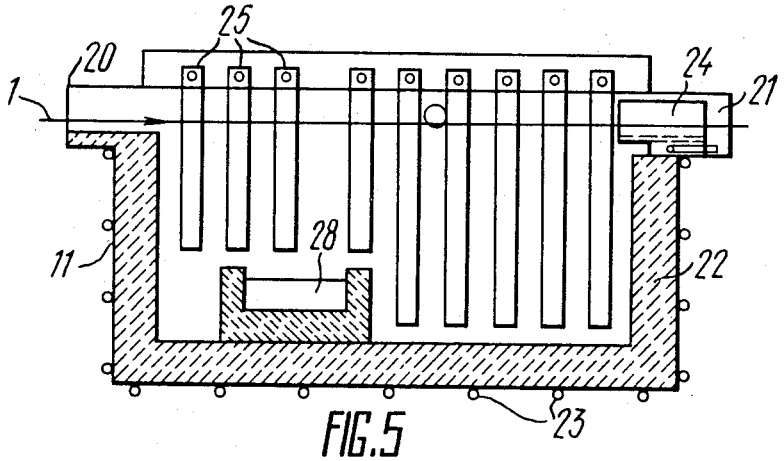
FIG. 5 is a bath for molten inorganic salts with a zinc-filled chamber according to the present invention (the bath is shown in elevation)

In another embodiment of the apparatus according to the present invention the anode of unit 8 for electrolytically coating the surface of wire 1 with a layer of zinc is made as a chamber 28 (FIG. 4, FIG. 5) filled with zinc and mounted inside the bath 11 which is employed as its bath with a solution for electrolysis.

Figure 6:
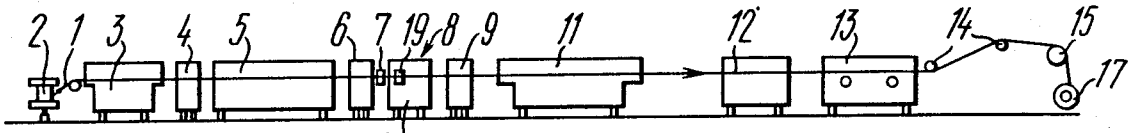
FIG. 6 is a structural scheme of the apparatus for the manufacture of a brass-plated long-size article, wherein as the unit for heating a moving long-size brass-plated article to the melting temperature of inorganic salts, as well as the straightening unit use is made of a bath with a melt of these salts according to the present invention.

In another embodiment of the apparatus according to the present invention shown in FIG. 6, in the apparatus for making a brass-plated long-size article as the unit of straightening and unit for heating of the article blank use is made of the bath 11 with molten salts, wherein thermodiffusive treatment and tempering of wire 1 are performed as well.

The apparatus for the manufacture of a brass-plated wire by the process according to the present invention operates in the following manner.

Wire 1 (FIG. 1) is uncoiled from unit 2 of uncoiling and passed through a bath 3 (FIGS. 1 and 2) with molten inorganic salts comprising, for example (per cent by weight): zinc chloride—48, aluminium fluoride—4, sodium chloride—22, potassium chloride—26 at a temperature within the range of from 280° to 420° C., current density of from 60 to 120 A/dm$^2$ and treatment duration of from 2.5 to 3.5 seconds. The melt temperature and current density depend on the degree of contamination of wire 1. It is advisable to effect surface preparation at a temperature by 100°–150° C. above the melting temperature of the melt to ensure a relatively low pressure of vapours above the melt and thus lower the entrainment of the salts with the moving wire 1.

Then wire 1 is washed in a bath 4 first with hot water at a temperature of from 60 to 80° C. and then with cold water at a temperature of below 25° C. to remove the remaining salts and cool the wire.

After the surface treatment, washing and cooling, a layer of copper is applied onto wire 1 in a bath 5 by dipping the wire into a known solution of copper sulphate containing for example (g/1): copper sulphate—60, sulphuric acid—40, bone glue—3 at a temperature of from 18° to 22° C. and residence time of 5–6 seconds.

In the solution wire 1 is coated with a layer of copper to a thickness of not less than 0.28 mm due to the difference of standard potentials of iron and copper respectively.

The copper-plated wire 1 is washed in the bath 6 with hot water at a temperature of from 40° to 60° C.and directed into the unit 7 for densification of the copper layer to produce a uniform and dense layer of copper on the surface of wire 1.

This treatment contributes to a further improvement of the phase composition of the composition of brass and results in an accelerated diffusion of zinc into copper during the subsequent thermodiffusive treatment.

Thereafter the wire 1 is coated with an electrolytically plated zinc layer in a unit 8 of electroplating of wire with a layer of zinc using a known solution for electrolysis.

Then the wire 1 with the copper and zinc coatings is washed in a washing bath 9 and heated in a unit 10 for wire heating to the melting temperature of the molten salts in bath 11.

In the bath 11 with molten inorganic salts containing, for example, per cent by weight: sodium chloride—28, potassium chloride—32, zinc chloride—40 a thermodiffusive treatment is effected at a temperature within the range of from 400° to 450° C. to produce a superficial layer of $\alpha$-brass and ensure tempering of wire 1 for 3–4 seconds. At the outlet from the slot 21 (FIG. 5) of bath 11 on the surface of wire 1 there is left a very thin layer of salts protecting the coating from oxidation. The cooling means 24 (FIGS. 2 and 3) prevents outflow of the melt and entrainment of the salts with wire 1. This arrangement of the cooling means 24 in the bath 11 contributes to a better stability of the process and considerably lowers the entrainment of molten salts with wire 1.

After bath 11 (FIG. 1) the brass-plated wire 1 is delivered into a bath 12 for a double washing with hot water, wherein there are effected the steps of washing of the surface and cooling of wire 1 to the temperature of 80° C.

The rapid cooling ensures a favourable distribution of inner stress, while washing provides for the removal of the residual salts from the non-oxidized brass layer and, consequently, an increased adherence to rubber.

Then wire 1 is dried in a wire-drying unit 13 and is delivered, through a system of guiding rolls 14, to a unit 15 for wire drawing. From the unit 15 the wire 1 is passed, through a straightening unit 16, to the wire coiling unit 17.

In still another embodiment of the apparatus according to the present invention wire 1 is heated to the temperature of melting of inorganic salts in bath 11 (FIG. 6). In doing so, straightening of wire 1 is also effected in bath 11 in combination with thermodiffusive treatment and tempering. Other operations of the apparatus functioning are similar to those of the embodiment described hereinbefore.

In the embodiment under consideration the electrolytical coating of the wire surface 1 with a layer of zinc is combined with tempering. Zinc admitted into the molten inorganic salts from the chamber 28 (FIGS. 4 and 5) is deposited on wire 1 heated in these salts.

Therefore, according to the present invention the chamber 28 filled with zinc provides a source of zinc for a normal and continuous process of its deposition on wire 1. It also provides for the possibility of maintaining the required phase composition of the brass coating on the surface of wire 1.

The present invention makes it possible to carry out straightening of a brass-plated long-size article during thermodiffusive treatment and tempering by the thermomechanical method.

The present invention also makes it possible to intensify and simplify the process for the manufacture of a brass-plated long-size article with reduction of labour expenses and material consumption due to combination of several operations in one unit and to decrease the apparatus length by 2.5 times with increasing productivity by 40%.

Furthermore, the present invention makes it possible to improve quality of the brass-plated long-size article, reduce the rate of consumption of electric power and auxiliary materials and reagents and lower the number of operating personnel.

Industrial Applicability

The apparatus for the manufacture of a brass-plated long-size article by the process according to the present invention can be useful in continuous processes for the manufacture of metal brass-plated articles such as wire or strip.

We claim:

1. A process for brass-plating a long-size article, such as wire or the like, comprising the steps of:

a. degreasing and etching the surface of a long-size article by immersion in a first bath of molten inorganic salts;

b. coating the degreased and etched article with a layer of copper by immersion in a bath comprising an acidic solution of copper sulfate;

c. electrolytically coating the copper coated article with a layer of zinc by immersion in an electrolytic bath which comprises zinc;

d. thermodiffusively treating and tempering the article by immersion in a second bath of molten inorganic salts, which salts have been heated to a temperature which does not exceed the temperature of recrystallization of said article by more than about 50° C., said treating causing at least some of the copper and at least some of the zinc to alloy, thereby forming brass; and e. straightening the article, by passing said article through a straightening means.

2. A process according to claim 1, wherein the step of straightening the article is accomplished in said second bath of molten inorganic salts in which said article is also thermodiffusively treated and tempered.

3. A process according to claim 1, wherein the step of electrolytically coating the copper coated article with a layer of zinc is accomplished by immersion of said article in an electrolytic bath of molten inorganic salts which comprises zinc.

4. A process according to claim 3, wherein the step of electrolytically coating the copper coated article with a layer of zinc is accomplished in said second bath of molten inorganic salts in which said article is also thermodiffusively treated and tempered.

5. A process according to claim 4, wherein the step of straightening the article is accomplished in said second bath of molten inorganic salts in which said copper coated article is electrolytically coated with zinc and said article is also thermodiffusively treated and tempered.

6. A process according to claim 1, which further comprises the step of densifying the layer of copper by accommodation in a densification means before the step of electrolytically coating the copper coated article with a layer of zinc.

7. A process according to claim 1, which further comprises the step of heating the copper and zinc coated article to a select temperature before said article is thermodiffusively treated and tempered.

8. A process according to claim 7, wherein the step of heating the copper and zinc coated article is accomplished in said second bath of molten inorganic salts in which said article is also thermodiffusively treated and tempered.

9. A process according to claim 1, wherein after passing through either or both of said baths of molten inorganic salts, said article is passed through a cooling means for preventing outflow and entrainment of the melt with said article, the cooling means including a plate with at least one recess which allows at least one of said articles to pass therethrough and a cooling chamber positioned next to said plate for reducing the temperature of said article as it is passed through said recess.

10. A process for brass-plating a long-size article, such as wire or the like, comprising the steps of:

a. degreasing and etching the surface of a long-size article by immersion in a first bath of molten inorganic salts;

b. coating the degreased and etched article with a layer of copper by immersion in a bath comprising an acidic solution of copper sulfate;

c. densifying the layer of copper by accommodation in a densification means;

d. immersing the copper coated article in an electrolytic bath of molten inorganic salts which comprise zinc and which have been heated to a temperature which does not exceed the temperature of recrystallization of said article by more than about 50° C., to accomplish therein the steps of:

(1) heating the article to the temperature of the bath;

(2) electrolytically coating the article with a layer of zinc;

(3) thermodiffusively treating and tempering the article; and (4) thermomechanically straightening the article.

11. A process according to claim 3, 4, 5, or 10, wherein said electrolytic bath of molten inorganic salts which comprises zinc, has a zinc filled chamber therein to provide a continuous source of zinc therefor.

* * * * *